United States Patent [19]

Baker

[11] Patent Number: 4,688,642

[45] Date of Patent: Aug. 25, 1987

[54] ROTATABLE LINER WITH MULTIPLE SIMULTANEOUSLY SET LINER HANGER ARRANGEMENT AND METHOD

[75] Inventor: Samuel F. Baker, Houston, Tex.

[73] Assignee: Texas Iron Works, Inc., Houston, Tex.

[21] Appl. No.: 821,969

[22] Filed: Jan. 29, 1986

Related U.S. Application Data

[63] Continuation of Ser. No. 658,656, Oct. 9, 1984, abandoned.

[51] Int. Cl.[4] ..... E21B 23/02

[52] U.S. Cl. ..... 166/382; 166/208; 166/212; 166/216; 166/217

[58] Field of Search ..... 166/208, 212, 216, 217, 166/285, 286, 382

[56] References Cited

U.S. PATENT DOCUMENTS

| | | | |
|---|---|---|---|
| 2,876,844 | 3/1959 | Warner | 166/208 |
| 3,291,220 | 12/1966 | Mott | 166/212 |
| 4,010,804 | 3/1977 | Garcia | 166/208 X |
| 4,058,166 | 11/1977 | Crickmer | 166/120 |
| 4,249,601 | 2/1981 | White | 166/208 |
| 4,281,711 | 8/1981 | Braddick et al. | 166/118 |
| 4,497,368 | 2/1985 | Baugh | 166/208 |
| 4,523,641 | 6/1985 | Manderscheid | 166/208 |
| 4,562,889 | 1/1986 | Braddick | 166/208 X |

*Primary Examiner*—James A. Leppink
*Assistant Examiner*—Hoang C. Dang
*Attorney, Agent, or Firm*—Jack W. Hayden

[57] ABSTRACT

A running string is releasably connected to a liner an liner hanger setting arrangement for lowering into a well bore casing and securing the liner to a casing. The liner hanger setting arrangement includes a first sleeve with upper and lower annular rows of conically shaped segments circumferentially spaced thereon. Upper and lower spaced rows of hanger slips are connected to a second sleeve by elongated strips and the second sleeve is releasably secured to the first sleeve whereby the second sleeve may be released from the sleeve for relative longitudinal movement therebetween to move the hanger slips onto the segments and secure the liner to the casing. The space between the segments in each row is substantial to accommodate relatively unrestricted fluid flow thereabout as the apparatus is manipulated and operations conducted in the well bore. After the running string is disconnected from the liner and liner hanger, it is lowered to releasably connect splines on the running string and upper end of the liner. The liner has a rotatable bearing above said sleeves and liner hanger and rotation of the running string is thus transmitted to the liner as it is cemented in the well bore.

36 Claims, 7 Drawing Figures

ROTATABLE LINER WITH MULTIPLE SIMULTANEOUSLY SET LINER HANGER ARRANGEMENT AND METHOD

CROSS REFERENCE TO RELATED APPLICATION

This is a continuation application of prior copending application Ser. No. 658,656, filed Oct. 9, 1984 now Abd. for "ROTATABLE LINER ARRANGEMENT WITH TANDEM CONE LINER HANGER.

BACKGROUND OF THE INVENTION

1. Field of the Invention

This invention relates generally to an arrangement for securing a liner to a well bore casing and cementing it in position in the well bore.

2. Description of the Prior Art

Single and dual cone liner hanger arrangements are well known in the art as is rotation of the liner with a single cone arrangement. However, prior to this invention, it has been accepted practice to use a plurality of single cone longitudinally spaced liner hanger arrangements with a rotating liner arrangement which greatly restricts fluid flow during the cementing operations conducted in a well bore.

The present invention overcomes this problem in that it provides a dual or tandem cone liner hanger arrangement which accommodates flow of fluid thereabout without any substantial restriction to such fluid flow while also accommodating rotation of the liner during the cementing operation.

DESCRIPTION OF THE PREFERRED EMBODIMENT

Figure 1A:
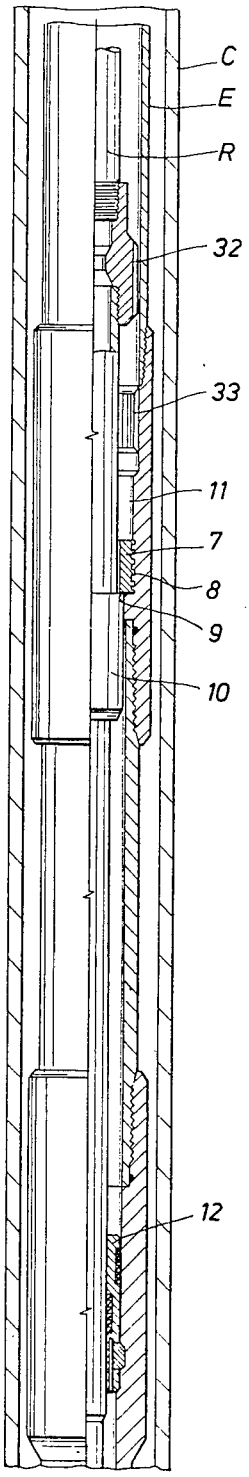
FIG. 1A is a longitudinal quarter sectional view of the upper end of a liner extension to which the liner is connected and showing a running string releasably connected therewith for lowering into a well bore.

Attention is first directed to FIG. 1A wherein a liner extension E is shown as being releasably connected to the running string R by means of a left-hand threaded nut 7 which surrounds the tubular portion 11 of the running string R and engages a thread 8 on the extension E. The nut abuts the shoulder 9 of the collar 10 on running string R. The portion 11 of the running string is noncircular as is the opening through the nut 7 through which it extends so that the nut 7 may be backed out of the threads 8 upon rotation of the running string. A seal bushing 12 is releasably secured to the liner extension E and includes seals to seal between the liner extension E and the running string R during cementing operations in the well bore. The retrievable bushing 12 is retrieved when the running string R is removed after the liner has been secured to the casing and the cementing operations conducted, the construction of such seal bushing being well known in the art. The upper extension E is provided at its lower end with rotatable bearing means referred to generally by the letter B. Abutting the lower end of the annular bearing means B are first sleeve means S, and the upper extension E extends longitudinally through the first sleeve means as shown in the drawings. The liner L is connected to the lower end 13 of the upper extension E and depends therefrom as shown.

The liner hanger setting arrangement is referred to generally by the letter H and is in effect part of the liner L by reason of the upper liner extension E which extends upwardly from the liner L as shown in the drawings and through the liner hanger arrangement H. The liner hanger arrangement H includes the first sleeve means S which extends longitudinally about the liner extension E as shown and the first liner sleeve means S is provided with upper and lower longitudinally spaced, annular rows 14 and 15 of conically shaped segments **14*a* and 15*a* respectively. It is to be noted that the conically shaped segments 14*a* in the upper row 14 are circumferentially spaced relative to each other by the spaces 14*b* therebetween and are offset circumferentially relative to the conically shaped segments 15*a* in the row 15. The segments 15*a* are circumferentially spaced relative to each other by the circumferential spaces 15*b* therebetween as illustrated. The conically shaped segments 14*a* and 15*a* of each row 14, 15, respectively, extend longitudinally of the first sleeve means S and the segments 14*a*, 15*a* are provided with an outwardly and upwardly tapered surface 14*c* and 15*c***, respectively, as shown.

Upper and lower longitudinally spaced annular rows of hanger slips 16 and 17, respectively, are formed by the hanger slips **16*a*, 17*a*, respectively, with the hanger slips 16*a* in row 16 being offset circumferentially relative to slips 17*a* in row 17 and with the slips 16*a* in the row 16 and the slips 17*a* in the row 17 being circumferentially spaced from each other to provide circumferential spaces therebetween whereby the hanger slips 16*a* are longitudinally aligned with the conically shaped segments 14*a* and the hanger slips 17*a* are longitudinally aligned with the segments 15*a* in the row 15. Elongated strips 16*b* are connected with the hanger slips 16*a* in row 16 and depend therefrom. The strips 16*b* extend longitudinally of the first sleeve means S and through the spaces 15*b* of the lower row 17 of the hanger slips 17** as shown and are connected at their lower ends to second sleeve means S'.

Figure 4:
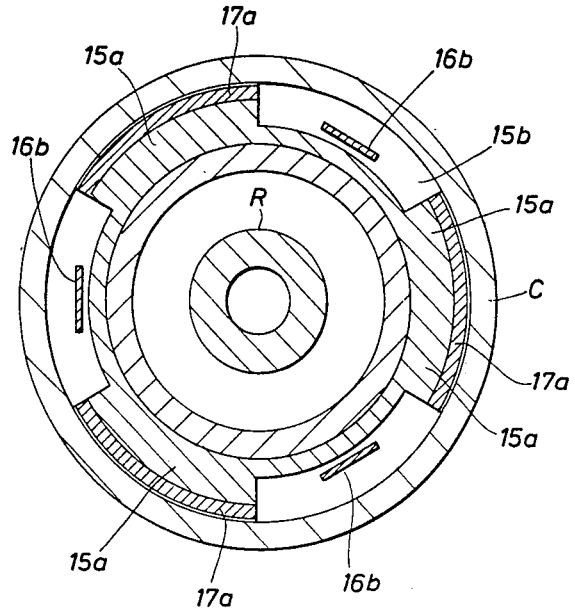
FIG. 4 is a sectional view on the line 4—4 of FIG. 2B.

Attention is directed to FIGS. 2 and 4 of the drawings wherein the hanger slips **17*a* of the lower row 17 are shown moved up onto tapered surfaces 15*c* of segments 15*a* and engaged with the casing C to secure the liner L therewith and it will be noted that the size of the longitudinal strips 16b connected with the slips 16a in the upper row 16 is relatively small compared with the extent of the space 15b between the conically shaped segments 15a. This provides an arrangement which accommodates substantially unrestricted flow of fluid during cementing operations of the liner in the well bore and overcomes the problems heretofore encountered in using a plurality of longitudinally spaced single cone liner hanger means in a rotatable liner arrangement. A strip 17b is connected to each of the hanger slips 17a and extends downwardly therefrom and is connected at its lower end to the second sleeve S' by means of bolts 19'** as shown.

Figure 5:
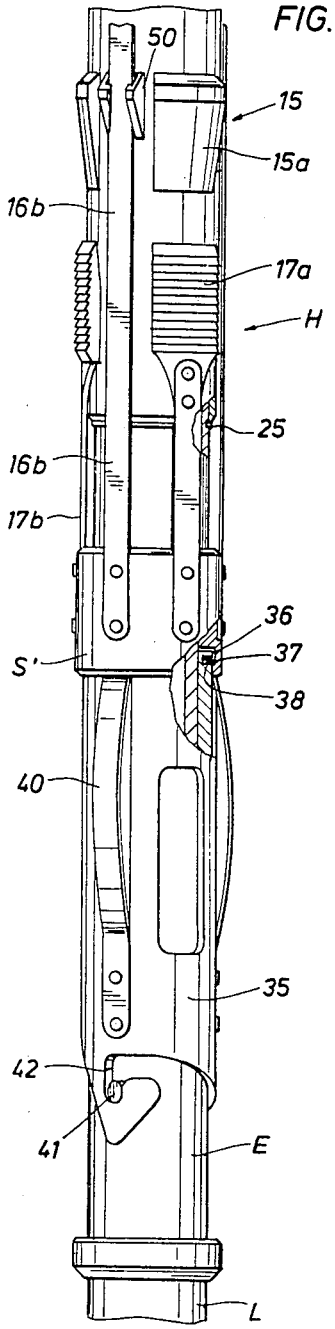
FIG. 5 demonstrates the lower portion of the present invention with a mechanical set liner hanger arrangement.

The lower end of the strip 16b is secured to the second sleeve S' by any suitable means such as nuts or bolts 19. The strips 16b are also secured to guide means G which includes a collar 20 connected to the strips 16b between the upper and lower rows 16, 17 of hanger slips 16a, 17a by the nuts or bolts 21. The guide means G also includes projection means 22 on collar 20 fitting in the longitudinal slot 23 of the sleeve S to maintain the hanger slips 16a in the row 16 aligned properly with the conically shaped segments 14a in the first annular row 14. In FIG. 5, the guide means G is in the form of a small bracket 50 positioned between the conical segments 15a through which bracket 50 the strips extend. This arrangement also does not restrict flow.

The lower end of the first sleeve means S is supported on the upper liner extension E by means of suitable projection means such as an annular ring as illustrated at 25.

Figure 1B:
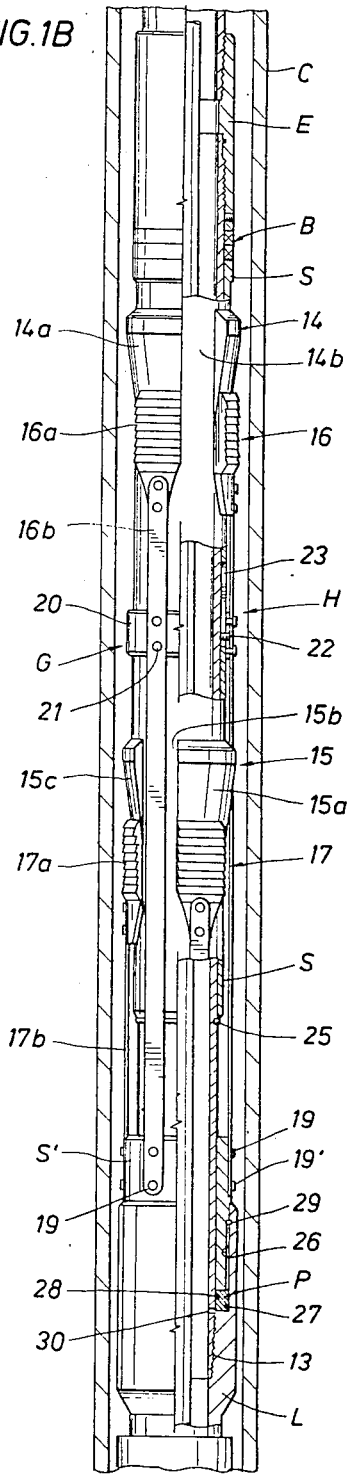
FIG. 1B is a continuation of the view illustrated in FIG. 1A showing a liner hanger including a tandem cone arrangement and bearing means thereabove to accommodate rotation of the liner after it has been secured to a well bore casing by the liner hanger arrangement.

The second sleeve means S' is received within the annular and longitudinally extending recess 26 formed between the lower end of liner extension E and the upper end of liner L as shown in FIG. 1B, with suitable piston means P having suitable seals 27 and 28 whereby the second sleeve means S' and the longitudinally extending strips 16b, 17b may be moved upwardly to position the hanger slips 16a, 17a on their respective segments when pressure fluid is supplied through the port 30 in liner extension E from the running string R in a manner well known to urge the piston means P and the second sleeve means S' upwardly. When the slips 16a, 17a are moved up and urged outwardly to engage casing C, sleeve S, liner extension E and liner L are secured to the casing C. The second sleeve means S' is releasably secured to liner L by shear pin 29, and when it is sheared by the movement of second sleeve S' relative to liner extension E, the second sleeve is released for longitudinal movement relative to sleeve S.

Figure 2A:
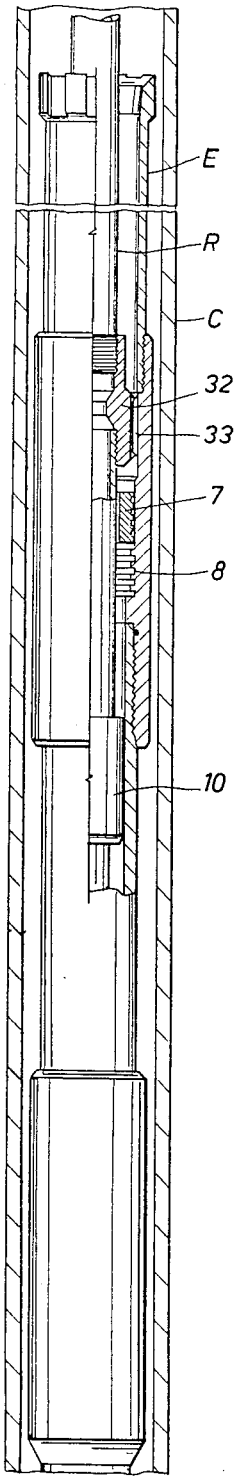
FIG. 2A is similar to FIG. 1A but demonstrates the position of the running string relative to the upper liner extension and after the running string has been disconnected therefrom and then reconnected therewith by lowering the running string for rotation of the liner.
Figure 2B:
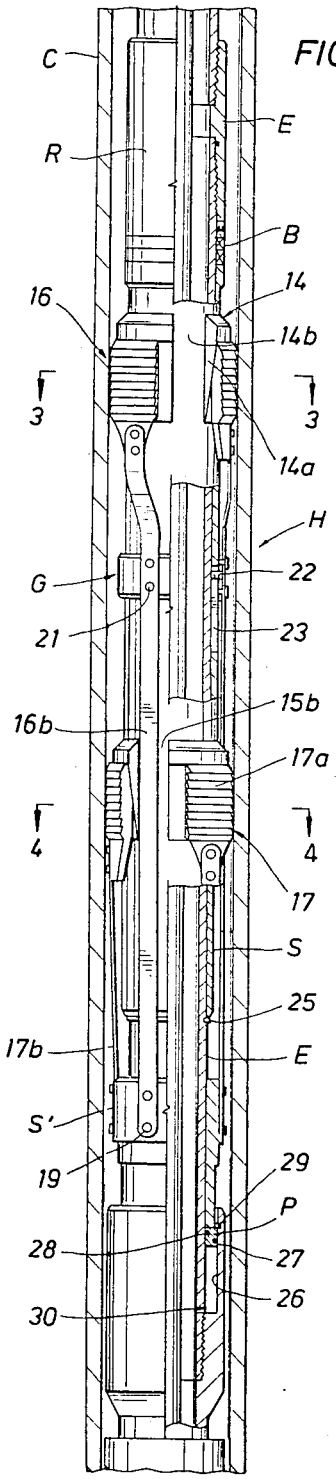
FIG. 2B is a continuation of FIG. 2A demonstrating the hanger slips of the hanger arrangement in position on the conically shaped segments of the hanger arrangement and engaged with the well bore casing to secure or hang the liner to the well bore casing.
Figure 3:
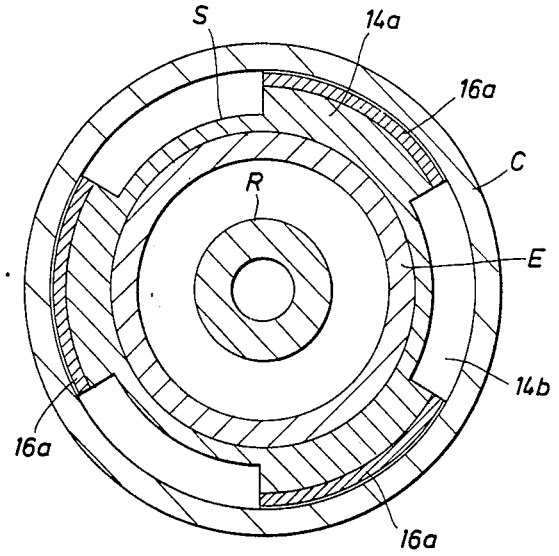
FIG. 3 is a sectional view on the line 3—3 of FIG. 2B demonstrating further structural details.

In FIGS. 2A, 2B, the form of liner hanger setting arrangement shown in FIGS. 1A and 1B is illustrated after the second sleeve S' has been moved upwardly by hydraulic pressure to engage the hanger slips 16a and 17a with the conically shaped segments 14a and 15a, respectively. Also, these figures show the well or running string R after the running strip has been rotated to release nut 7 from liner extension E and liner hanger H, and the running string R lowered to engage the upper liner extension E for rotation of the liner L during cementing operations. A plurality of circumferentially spaced external projections 32 are provided on the running string R which engage with a plurality of circumferentially spaced internal projections 33 on the extension E whereby rotation of the running string R will rotate the liner L and the upper liner extension E by means of the bearing B above the upper row 14 of conically shaped segments. Specifically, the sleeve S is secured to the casing since at this time segments 14a, 15a and slips 16a, 17a on sleeve S are engaged with casing C. Further, the extension E extends through sleeve S and is rotatable by the rotation of the running string relative to first sleeve means S as it is secured by slips 16a, 17a to casing C, as above described.

In FIG. 5, the invention is demonstrated where a mechanically set form of liner hanger arrangement H is employed. It can be appreciated that the portion of the invention above the row 15 of conically shaped segments 15a is identical to that illustrated in FIGS. 1B and 1A and that the operation and function of the invention is substantially the same with the exception that the hanger arrangement H is mechanically set as opposed to being hydraulically set. Similar numbers are applied to similar parts.

In the form shown in FIG. 5, an extension 35 of the second sleeve S' is provided which is rotatably supported by the second sleeve S' and depends therefrom by reason of the overhanging annular shoulder 36 resting on a ring 37 supported on the ledge 38 of second sleeve S'. Circumferentially spaced bow springs 40 extend longitudinally of the depending portion 35 of second sleeve means S' and a pin 41 is provided on the extension E as shown. When slight rotation is imparted to the running string R before the left-hand nut 7 is disengaged, rotation of the liner hanger arrangement H is restrained by the bow springs 40 so that the extension E rotates with the running string R to thereby disengage pin 41 from the J slot arrangement 42 in second sleeve S'. The J slot 42 and pin 41 form the releasable connection between the second sleeve S' and liner L in the FIG. 5 form. Also, the circumferentially spaced bow springs 40 restrain longitudinal movement between the liner hanger arrangement H and the upper entension E so that subsequent lowering of the running string R effects relative longitudinal movement between the second sleeve means S' and the extension E, including first sleeve means S, to urge the slips 16a, 17a onto their respective conically shaped segments for securing the liner L to the casing C. Thereafter, rotation of the running string R may be effected to disconnect the nut 7 from the liner extension E, as previously described, so that running string R is disconnected from extension E, liner L and liner hanger H. The running string R is then lowered to engage the splines 32 with the splines 33 for rotation of the liner L in a manner as previously described as the liner L is cemented in the well bore.

The foregoing disclosure and description of the invention are illustrative and explanatory thereof, and various changes in the size, shape and materials as well as in the details of the illustrated construction may be made without departing from the spirit of the invention.

What is claimed is:

1. A rotatable liner and liner hanger setting arrangement to accommodate substantially unrestricted fluid flow in the well bore casing thereabout comprising:

a. a running string for lowering the liner and liner hanger setting arrangement into the well bore;

b. means to releasably connect the liner and liner hanger setting arrangement with the running string;

c. said liner hanger setting arrangement being supported on the liner for engaging with the well bore casing to secure the liner therewith, said arrangement including:

1. first sleeve means extending longitudinally about the liner;

2. upper and lower longitudinally spaced, annular rows of conically shaped segments on said first sleeve means, said segments in each row being circumferentially spaced about said first sleeve means with the segments in the first row being generally circumferentially offset from the segments in the second row, said conically shaped segments extending longitudinally on said first sleeve means and tapered upwardly and outwardly relative thereto;
3. upper and lower longitudinally spaced rows of hanger slips circumferentially spaced and longitudinally aligned with the conically shaped segments whereby the hanger slips may be moved along said sleeve means and into engagement with the well bore casing to secure the liner hanger and liner thereto;
4. elongated strips secured to and depending longitudinally from each of said slips and circumferentially spaced about said first sleeve means with the strips from the upper row of hanger slips extending through the space between the segments in the lower row, the space between the segments in each row being of substantially larger circumferential extent than said strips;
5. second sleeve means slidably secured on the liner with which the lower ends of said strips are secured;
6. means to releasably secure said second sleeve means to the liner whereby said second sleeve means may be released for relative longitudinal movement between it and said first sleeve means whereupon said hanger slips move onto the conically shaped segments and engage the well bore casing to secure the liner therewith;
7. guide means connecting said strips to said second sleeve means to maintain the hanger slips aligned with their respective conically shaped segments; and
8. bearing means on the liner above said first sleeve means to accommodate rotation of the liner after it has been secured to the casing; and d. means on the running string releasably engageable with the liner upon lowering the running string for rotating the liner by rotating the running string after the running string and liner hanger setting arrangement have been disconnected from each other.

2. A method of suspending a liner from well pipe in a well bore to accommodate rotation of the liner comprising:

supporting on a running string a liner with a pair of sleeves thereon for relative rotation between the pair of sleeves and the liner with the pair of sleeves cooperating to form multiple longitudinally spaced apart liner hangers on one of the sleeves;

lowering the running string with the liner and pair of sleeves into the well bore;

simultaneously securing all the multiple longitudinally spaced liner hangers and pair of sleeves to the well pipe to suspend the liner from the well pipe; and rotating the suspended liner relative to the pair of sleeves and well pipe.

3. The method of claim 2 wherein the simultaneous securing of all the liner hangers is accomplished by moving one of the pair of sleeves longitudinally relative to the other.

4. The method of claim 3 wherein the longitudinal movement of one of the pair of sleeves is in response to pressure fluid in the liner.

5. The method of claim 3 wherein the running string is manipulated to effect longitudinal movement of one of the pair of sleeves relative to the other.

6. A liner hanger setting arrangement for lowering with a liner on a running string to secure the liner in a well bore and accommodate rotation of the liner comprising:

upper and lower spaced sleeve means on the liner; bearing means to accommodate rotation of the liner relative to said spaced sleeve means;

at least two rows of conically shaped segments on said upper sleeve means;

at least two rows of hanger slips on said lower sleeve means with the hanger slips in one row being offset circumferentially relative to the hanger slips in the other row to align each row of hanger slips with a respective row of conically shaped segments;

connecting means for connecting each of said hanger slips with said lower sleeve means; and means to effect relative longitudinal movement between said upper and lower sleeve means to simultaneously engage all said rows of hanger slips on said respective rows of conical segments to secure the liner in the well bore.

7. The liner hanger setting arrangement of claim 6 wherein said means which effects simultaneous engagement of all said rows of hanger slips and segments includes fluid pressure responsive means operably associated with one of said sleeve means for moving it longitudinally toward the other of said sleeve means.

8. The liner hanger setting arrangement of claim 6 wherein said means which effects simultaneous engagement of all said rows of hanger slips and segments includes means responsive to manipulation of the running string to effect the relative longitudinal movement between said upper and lower sleeve means.

9. The liner hanger setting arrangement of claim 6 including means on the runing string and liner engagable upon manipulation of the running string to impart rotation to the liner after it is secured in the well bore.

10. The liner hanger setting arrangement of claim 7 wherein said fluid pressure responsive means is operably associated with said lower sleeve means for moving it longitudinally toward said upper sleeve means.

11. The liner hanger setting arrangement of claim 6 including means to disconnect the running string from the hanger setting arrangement.

12. The liner hanger setting arrangement of claim 6 including guide means supported on said first sleeve means for movement relative thereto and secured with each of said connecting means for movement therewith.

13. The liner hanger setting arrangement of claim 12 wherein said guide means includes a collar connected with each of said connecting means and means for accommodating relative longitudinal movement between said collar and first sleeve means while inhibiting relative rotation therebetween.

14. The liner hanger setting arrangement of claim 6 including means to maintain said hanger slips in each row aligned with said conically shaped segments in a respective row.

15. A liner hanger setting arrangement to secure a liner in a well bore and to accomadate rotation of the liner comprising:

first sleeve means on the liner;

means supporting said first sleeve means for rotation of the liner relative thereto;

second sleeve means mounted on the liner for rotation of the liner relative thereto;

at least two rows of conically shaped segments on one of said sleeve means;

at least two rows of hanger slips with the hanger slips in one row offset circumferentially relative to the hanger slips in the other row to align each row of hanger slips with a respective row of conically shaped segments;

connecting means connecting each of said hanger slips with the other of said sleeve means;

means operable to effect relative longitudinal movement between said first and second sleeve means to simultaneously engage all said rows of hanger slips on said respective rows of segments and secure the liner in position in the well bore; and bearing means to accomodate rotation of the liner relative to said first and second sleeve means.

16. The liner hanger setting arrangement of claim 15 including means to maintain said hanger slips in each row aligned with said conically shaped segments in a respective row.

17. A liner hanger setting arrangement to secure a liner to a well string to accommodate rotation of the liner by a running string during cementing operations in a well bore including:

means to releasably connect the running string with the liner and liner hanger setting arrangement;

first sleeve means mounted on the liner for rotation of the liner relative thereto;

at least two longitudinally spaced annular rows of conically shaped, circumferentially spaced segments on said first sleeve means with the segments in each row being offset circumferentially;

second sleeve means mounted on the liner for rotation of the liner relative thereto, said second sleeve being spaced from said first sleeve means;

at least two rows of hanger slips on said second sleeve means with the hanger slips in each row being offset circumferentially and with the hanger slips in each row being aligned with the segments in a row of segments;

elongated strips secured to said hanger slips adjacent one end and to said second sleeve means at the other end;

means to releasably secure said second sleeve means to the liner whereby said second sleeve means may be released for relative longitudinal movement between it and said first sleeve means to simultaneously engage all said rows of hanger slips on said respective rows of conical segments to secure the liner in the well string;

means to maintain said hanger slips aligned with their respective conically shaped segments;

bearing means on the liner to accommodate rotation of the liner after it has been secured on the well string; and means on the running string releasably engagable with the liner for rotating the liner after the liner hanger setting arrangement and liner are released from the running string.

18. The method of claim 2 including the steps of:

sealing off between the running string and liner; and cementing and rotating the liner in the well bore.

19. The liner hanger setting arrangement of claim 6 including seal means on the running string for sealing between the liner and running string.

20. The liner hanger arrangement of claim 15 wherein said means which is operable to effect simultaneous engagement of all said rows of hanger slips and segments includes fluid pressure responsive means operably associated with one of said sleeve means for moving it longitudinally toward the other of said sleeve means.

21. The liner hanger setting arrangement of claim 15 including means to support it with a running string, and seal means on the running string for sealing between the liner and running string.

22. The liner hanger setting arrangement of claim 21 wherein said means which is operable to effect simultaneous engagement of all said rows of hanger slips and segments includes means responsive to manipulation of the running string to effect the relative longitudinal movement between said first and second sleeve means.

23. The liner hanger setting arrangement of claim 21 including means on the running string and liner engagable upon manipulation of the running string to impart rotation to the liner after it is secured in the well bore.

24. The liner hanger setting arrangement of claim 15 wherein said fluid pressure responsive means is operably associated with said second sleeve means for moving it longitudinally toward said first sleeve means.

25. The liner hanger setting arrangement of claim 21 including means to disconnect the running string from the hanger setting arrangement.

26. The liner hanger setting arrangement of claim 15 including means to maintain said hanger slips in each row aligned with said conically shaped segments in a respective row.

27. A method of supporting a liner on a well bore pipe comprising the steps of:

rotatably supporting on the liner a first sleeve with multiple rows of longitudinally spaced, conically shaped segments thereon and a second sleeve longitudinally spaced from the first sleeve and supporting multiple rows of longitudinally spaced hanger slips for simultaneously engaging with all the rows of hanger slips and conically shaped segments on the first sleeve means to secure the sleeves to the well bore pipe to support the liner for relative rotation between the liner and sleeves secured to the well bore pipe;

releasably securing a seal bushing on the liner and supporting the seal bushing on a running string for lowering the liner with the sleeves thereon on the running string into the well bore pipe;

simultaneously engaging each of the rows of hanger slips with a respective row of conically shaped segments on the first sleeve to secure the first and second sleeves to the well bore pipe;

disconnecting the running string from the liner and moving the running string longitudinally relative to the seal bushing secured on the liner while maintaining a seal between the running string and liner to engage the running string and liner for rotation of the liner by the running string; and rotating the liner relative to the first and second sleeves.

28. The method of claim 27 wherein the simultaneous engagement of the rows of hanger slips with the rows of conically shaped segments is effected by manipulating the running string to move at least one of either the first or second sleeves longitudinally.

29. The method of claim 28 wherein the longitudinal movement between the sleeves is in response to pressure fluid in the liner.

30. An arrangement for lowering on a running string to support a liner on a well bore pipe for rotation by the running string including:

multiple, longitudinally spaced liner hangers, said liner hangers including:

first sleeve means on the liner;

bearing means supporting said first sleeve means for rotation of the liner relative to said first sleeve means;

second sleeve means mounted on the liner and supported by said first sleeve means for rotation of the liner relative thereto; and co-engagable means on said first and second sleeve means which are engagable on one of said sleeve means to form said multiple, longitudinally spaced liner hangers on one of said sleeve means;

means to effect relative longitudinal movement between said first and second sleeve means to simultaneously engage said co-engagable means and thereby simultaneously engage all said longitudinally spaced liner hangers with the well bore pipe;

circumferentially spaced, external rigid projections on the running string; and circumferentially spaced, internal rigid projections on the liner engagable by said projections on the running string for rotation of the liner by the running string.

31. The arrangement of claim 30 wherein said means to effect simultaneous engagement of all said liner hangers with the well bore pipe includes fluid pressure responsive means operably associated with one of said sleeve means for effecting relative longitudinal movement therebetween.

32. The arrangement of claim 30 wherein said means to effect simultaneous engagement of all said liner hangers with the well bore pipe includes means responsive to manipulation of the running string to effect relative longitudinal movement between said first and second sleeve means.

33. The arrangement of claim 30 including seal means on the running string for securing with the liner and sealing between the liner and running string while accommodating relative movement between the running string and the liner, said seal means retrievable when the running string is removed from the well bore.

34. The invention of claim 17 wherein the means to releasably secure said second sleeve means to the liner comprises shear means, and wherein the lower end of said second sleeve means is telescopically received within an annular chamber in the liner, piston means abutting the lower end of said second sleeve means within the annular chamber and having seal means responsive to fluid pressure from the running string for moving said second sleeve means longitudinally of said first sleeve means for engagement of the hanger slips with the conically shaped segments.

35. The apparatus of claim 17 wherein the means to releasably secure said second sleeve means to the liner includes a J slot on said second sleeve means and a projecting pin on the liner normally engaged in the J slot as the running string is lowered into the well bore, but which may be disengaged by rotation of the running string to release the second sleeve means; bow spring means on said second sleeve means to restrain rotation of said second sleeve means relative to the running string as it is rotated whereby said pin and J slot disengage to release said second sleeve means for relative longitudinal movement between it and said first sleeve means.

36. The liner hanger setting arrangement of claim 22 including engagable means on the running string and liner which are engagable upon longitudinal movement of the running string relative to the liner to rotate the liner relative to said upper and lower sleeves when the liner is secured for rotation in the well bore by the running string; and wherein said seal means is a seal bushing on the running string which is retrieved when the running string is removed from the well bore, said seal bushing having means thereon to releasably secure said seal bushing to the liner for maintaining a seal between the liner and running string while the running string is moved longitudinally relative to the liner and seal bushing.

* * * * *

UNITED STATES PATENT AND TRADEMARK OFFICE

CERTIFICATE OF CORRECTION

PATENT NO. : 4,688,642

DATED : August 25, 1987

INVENTOR(S) : Samuel F. Baker

It is certified that error appears in the above-identified patent and that said Letters Patent are hereby corrected as shown below:

Line 1 of the ABSTRACT, "an" should be --and--.

Column 10, line 5, "17" should be --1--.

Column 10, line 16, "17" should be --1--.

Signed and Sealed this

Twelfth Day of January, 1988

*Attest:*

DONALD J. QUIGG

*Attesting Officer*

*Commissioner of Patents and Trademarks*